US007882606B2

(12) United States Patent
Elhaj

(10) Patent No.: US 7,882,606 B2
(45) Date of Patent: Feb. 8, 2011

(54) COFFIN CARRIAGE ASSEMBLY

(76) Inventor: Antoine Elhaj, 3712 Columbus Ave., Sandusky, OH (US) 44870

( * ) Notice: Subject to any disclaimer, the term of this patent is extended or adjusted under 35 U.S.C. 154(b) by 40 days.

(21) Appl. No.: 12/492,949

(22) Filed: Jun. 26, 2009

(65) Prior Publication Data

US 2010/0212125 A1 Aug. 26, 2010

Related U.S. Application Data

(63) Continuation-in-part of application No. 12/468,861, filed on May 19, 2009, and a continuation-in-part of application No. 12/430,882, filed on Apr. 27, 2009, and a continuation-in-part of application No. 12/390,400, filed on Feb. 20, 2009.

(51) Int. Cl.
*A61G 17/00* (2006.01)

(52) U.S. Cl. ..... 27/27; 296/16; 296/18

(58) Field of Classification Search ..... 27/27; 211/85.16; 296/16–18; 414/529, 532, 536
See application file for complete search history.

(56) References Cited

U.S. PATENT DOCUMENTS

| | | | | | |
|---|---|---|---|---|---|
| 1,565,195 | A * | 12/1925 | Parsels | 414/529 |
| 2,007,119 | A * | 7/1935 | Harris | 27/35 |
| 2,143,285 | A * | 1/1939 | Schofield | 296/41 |
| 2,148,245 | A * | 2/1939 | Runkle | 414/532 |
| 2,666,666 | A * | 1/1954 | Schneider et al. | 296/16 |
| 2,813,642 | A * | 11/1957 | Fisher | 414/536 |
| 3,133,334 | A * | 5/1964 | Johnsen | 27/27 |
| 3,389,815 | A * | 6/1968 | Houser | 414/536 |
| 3,720,329 | A * | 3/1973 | Gamble | 414/531 |
| 4,787,808 | A * | 11/1988 | Shimoji et al. | 414/531 |
| 7,316,437 | B2 * | 1/2008 | Sinclair | 296/16 |
| 2009/0302572 | A1 * | 12/2009 | Bryant, II | 280/414.1 |

* cited by examiner

*Primary Examiner*—William L. Miller
(74) *Attorney, Agent, or Firm*—Ronald J. Koch

(57) ABSTRACT

A Coffin Carriage assembly 300 has first and second side rails 301, 302, a front rail 303, a back rail 304, a plurality of rollers 305, a rear support wall 306, a rear support pad 307, and retaining strap 320; and is suitable for transporting coffins having curved bottoms in funeral coaches.

3 Claims, 5 Drawing Sheets

COFFIN CARRIAGE ASSEMBLY

The present application is a continuation in part of copending patent application Ser. Nos:

Ser. No. 12/468,861 of Antoine Elhaj, filed May 19, 2009, entitled "Broken Heart Shaped Vault";

Ser. No. 12/430,882 of Antoine Elhaj, filed Apr. 27, 2009, entitled "Broken Heart Shaped Coffin";

and Ser. No. 12/390,400 of Antoine Elhaj, filed Feb. 20, 2009, entitled "Broken Heart Shaped Coffin" and based on which priority is herewith claimed under 35 U.S.C. 120 and the disclosure of which is incorporated herein by reference in its entirety as if fully rewritten herein.

CROSS REFERENCE TO RELATED APPLICATIONS application Ser. No. 12/468,861, filed May 19, 2009; Ser. No. 12/390,400, filed Feb. 20, 2009; Ser. No. 12/430,882, filed Apr. 27, 2009.

FEDERALLY SPONSERED RESEARCH

Not Applicable

SEQUENCE LISTING, TABLE, OR COMPUTER PROGRAM COMPACT DISK APPENDIX

Not Applicable

CLAIM OF PRIORITY BASED ON COPENDING APPLICATION claims benefit of utility application Ser. Nos. 12/468,861, 12/390,400 & 12/430,882

BACKGROUND AND SUMMARY

The present invention relates generally to coffins and specifically to systems and methods of transporting coffins and achieves the objects and advantages as disclosed herein and in the various applications that are incorporated herein by reference, and those that are apparent to those of skill in the art. Generally, the purpose of the carriage assembly of the present invention is to secure a coffin in place as the coffin and carriage are secured within a funeral coach (a.k.a. hearse); specifically, the purpose is to secure a coffin having a curved bottom such as those depicted herein and additionally as depicted in U.S. application Ser. No. 12/390,400 (incorporated herein by reference).

REFERENCE NUMERALS IN DRAWINGS

Figure 1:
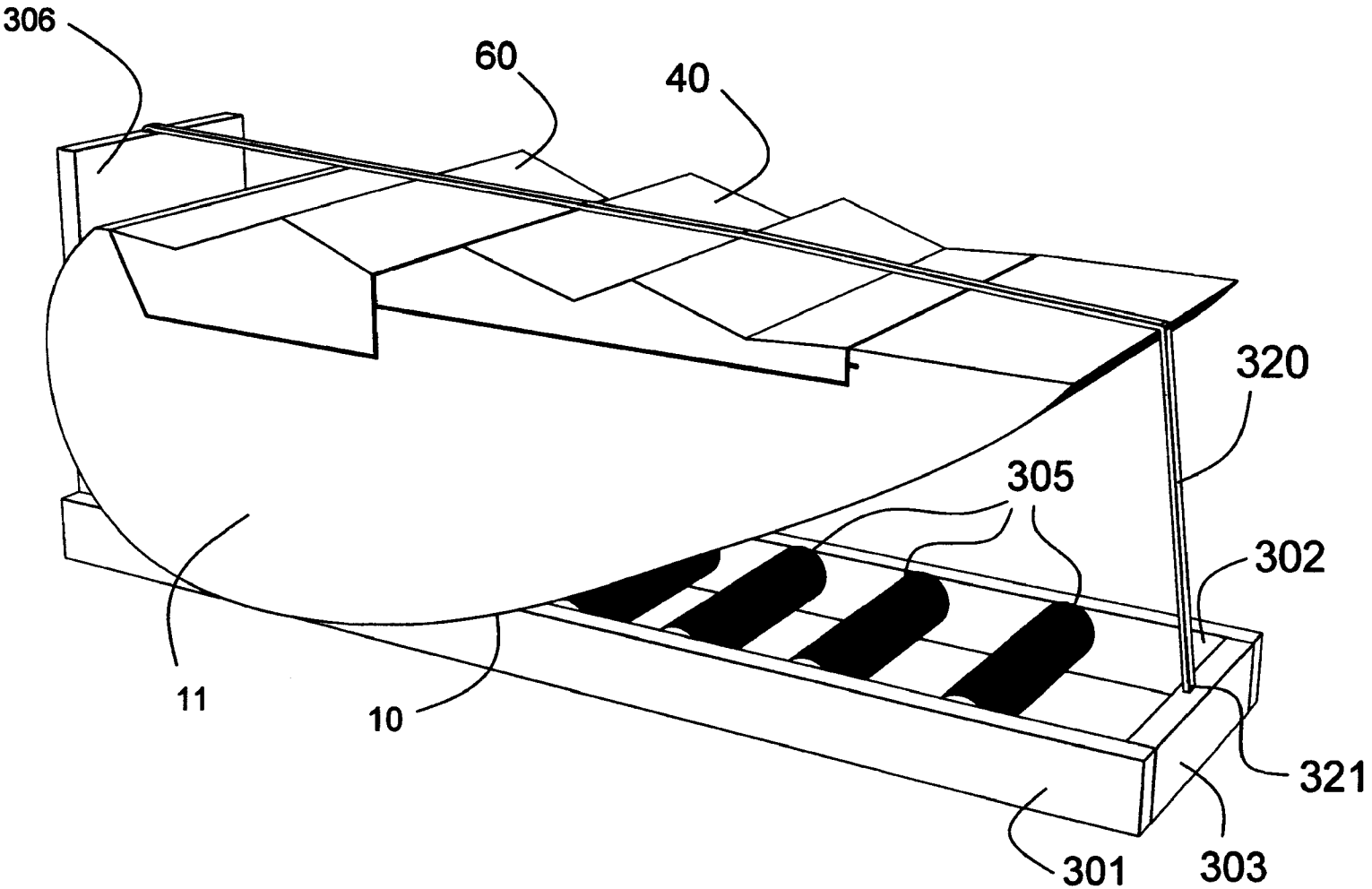
FIG. 1 depicts a perspective view of one embodiment of the carriage assembly with coffin attached

The table below lists the reference numerals employed in the figures, and identifies the element designated by each numeral.

coffin 1
curved bottom surface 10 of coffin
vertical side walls 11 of coffin
lobes 16 of vertical side walls of coffin
recessed flat portion 17 of coffin
first cover portion 40 of coffin
second cover portion 60 of coffin
carriage assembly 300
first side rail 301 of carriage assembly
second side rail 302 of carriage assembly
front rail 303 of carriage assembly
back rail 304 of carriage assembly
rollers 305 of carriage assembly
rear support wall 306 of carriage assembly
rear support pad 307 of carriage assembly
arrow 308 indicating direction of movement of rear support wall
retaining strap 320 of carriage assembly
retaining clip 321 for retaining strap of carriage assembly
funeral coach 400
floor mounted rollers 401 of funeral coach
floor mounted support brackets 402 of funeral coach

DETAILED DESCRIPTION

A Coffin Carriage assembly 300 comprises first and second side rails 301, 302, a front rail 303, a back rail 304, a plurality of rollers 305, a rear support wall 306, a rear support pad 307, and retaining strap 320, and is constructed with metal (preferably light weight) and utilizes conventional rollers, bearings, retaining straps and clips.

First and second side rails 301, 302 each have front and rear portions, and are laterally spaced apart. Front rail 303 is attached between first and second side rails 301, 302 approximate the front portions thereof. Back rail 304 is attached between the first and second side rails approximate the rear portions thereof.

A plurality of rollers 305 are attached with bearings to the inside of first and second side rails 301, 302 between the front and back rails 303, 304 such that the top of each of the rollers extends upwardly above the top of the first and second side rails 301, 302. This is to allow a flat surface (see below) to engage the rollers. In one embodiment there are seven rollers, but other combinations are possible.

Figure 2:
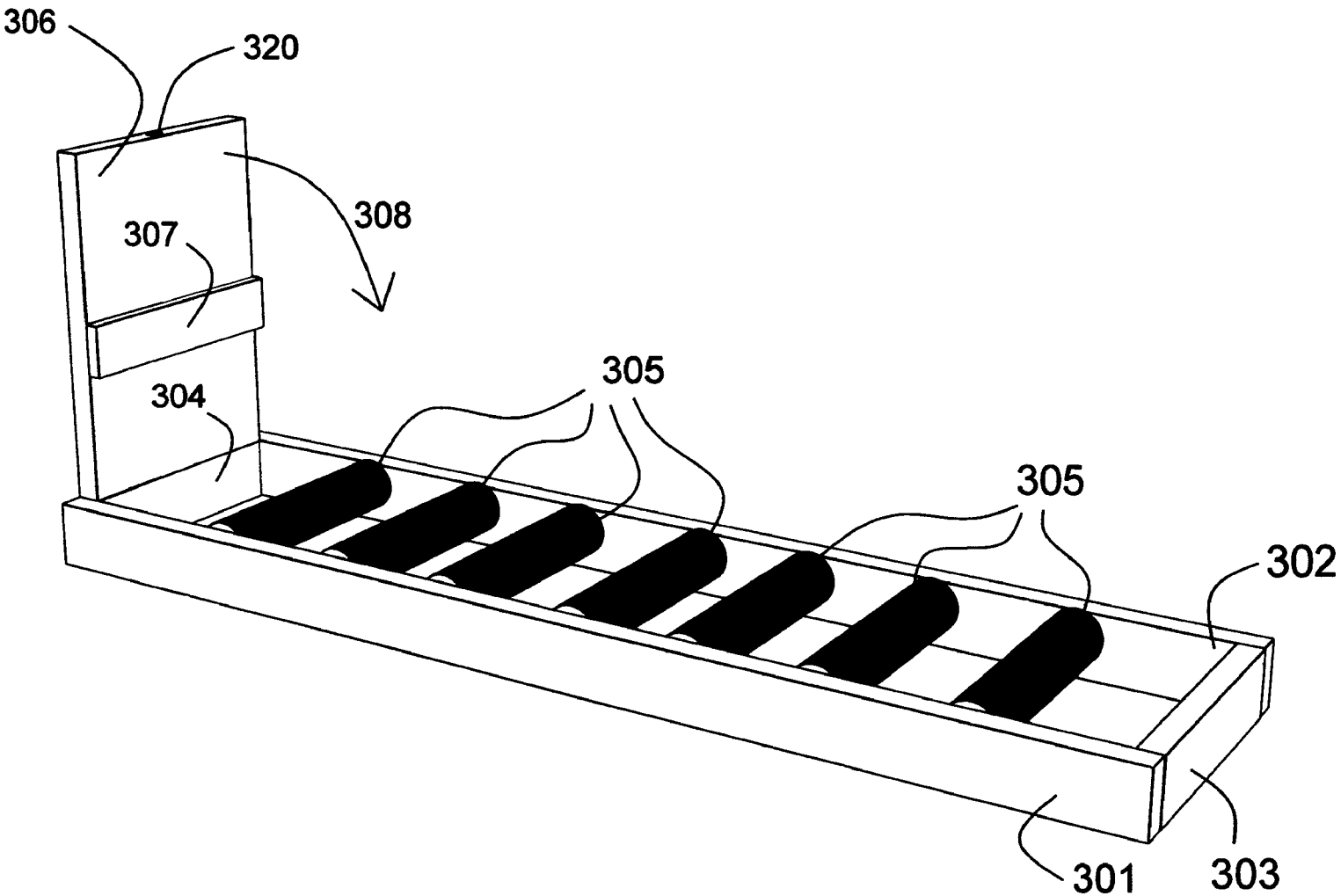
FIG. 2 depicts a perspective view of one embodiment of the carriage assembly
Figure 4:
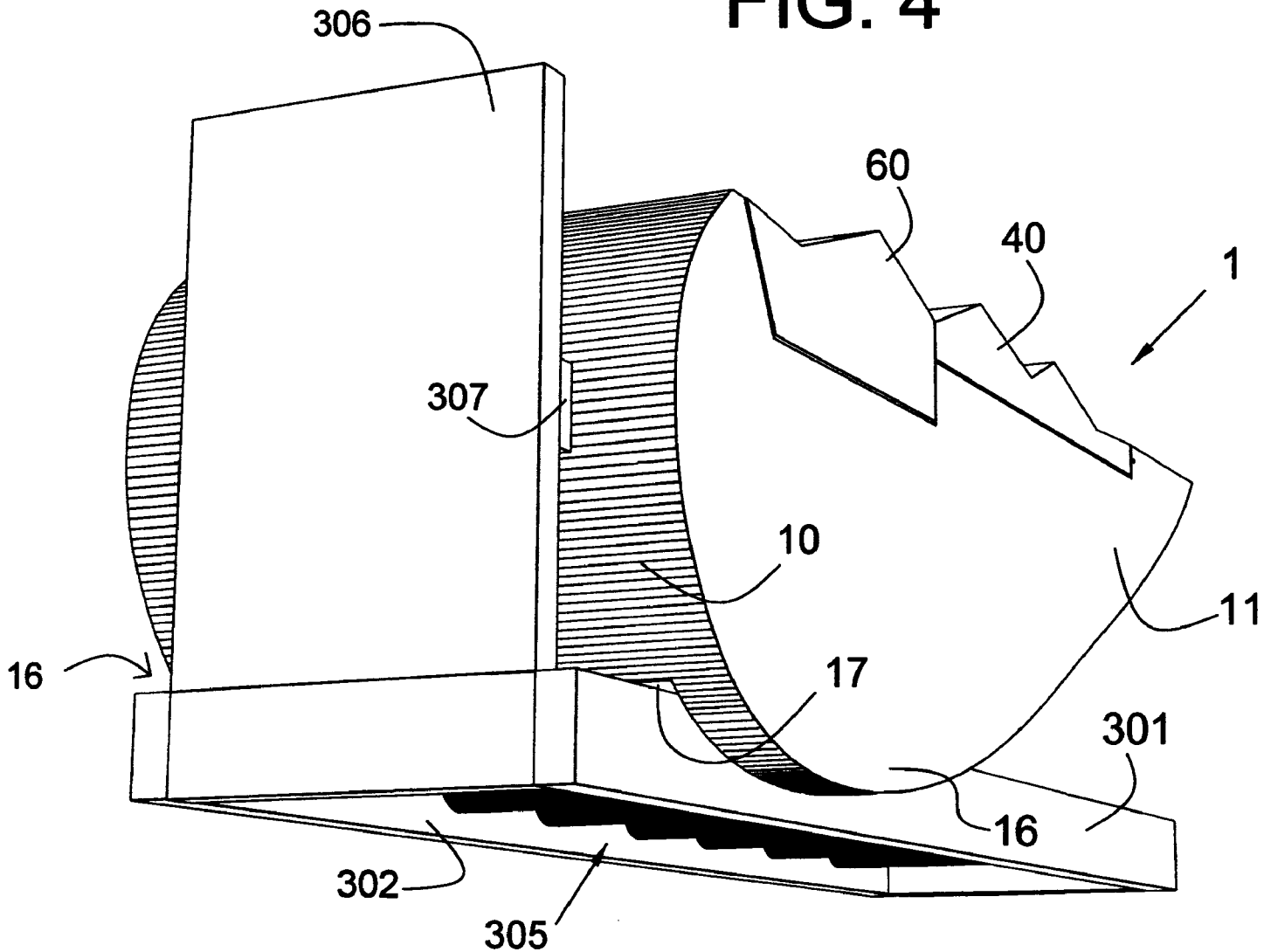
FIG. 4 depicts a perspective view of one embodiment of the present invention showing a lobe of a vertical side wall of a coffin at rest on the carriage assembly

Rear support wall 306 is hingedly connected to back rail 304, and extends vertically upward in a first open position (preferably locked in place), and is horizontally oriented in a second closed position (closed in the direction of arrow 308 in FIG. 2). The open position (FIGS. 1 & 4) is used to restrain a coffin. The closed position is used for transporting the carriage assembly when not in use. Rear support pad 307 is connected to the rear support wall 306 such that it will engage the coffin. Its purpose is to protect the coffin from scratching and also to help secure it.

Retaining strap 320 has retracted and extended positions. Like an automobile seat belt, it is rolled up in the retracted position (rear support wall 306 is adapted to have a recess to house rolled up strap 320) and unrolled to an extended position and attached to front rail 303 with clip 321. FIG. 1 depicts the strap 320 holding a coffin in place. FIG. 2 depicts belt 320 in a retracted, or rolled up, state.

Coffin 1 has a curved bottom surface 10, a recessed flat portion 17 in the curved bottom surface, two vertical side walls 11 each having downwardly oriented lobes 16, and first and second cover portions 40, 60. It can be placed on top of carriage assembly 300 such that the recessed flat portion 17 of the coffin engages the plurality of rollers 305, and first and second side rails 301, 302 are disposed inside of lobes 16.

Carriage assembly 300 can be placed in a funeral coach 400 (not shown in its entirety) having floor mounted rollers 401, such that the bottom of the first and second side rails 301, 302 engage the floor mounted rollers 401. The carriage assembly is secured in place using the retaining system of the funeral coach wherein removable vertical brackets (not shown) are secured to floor mounted support brackets 402 of funeral coach to restrain the contents from longitudinal movement. Then, the coffin (as described above) can be placed on top of the carriage assembly, the combination being secured within the funeral coach for transport.

Figure 3:
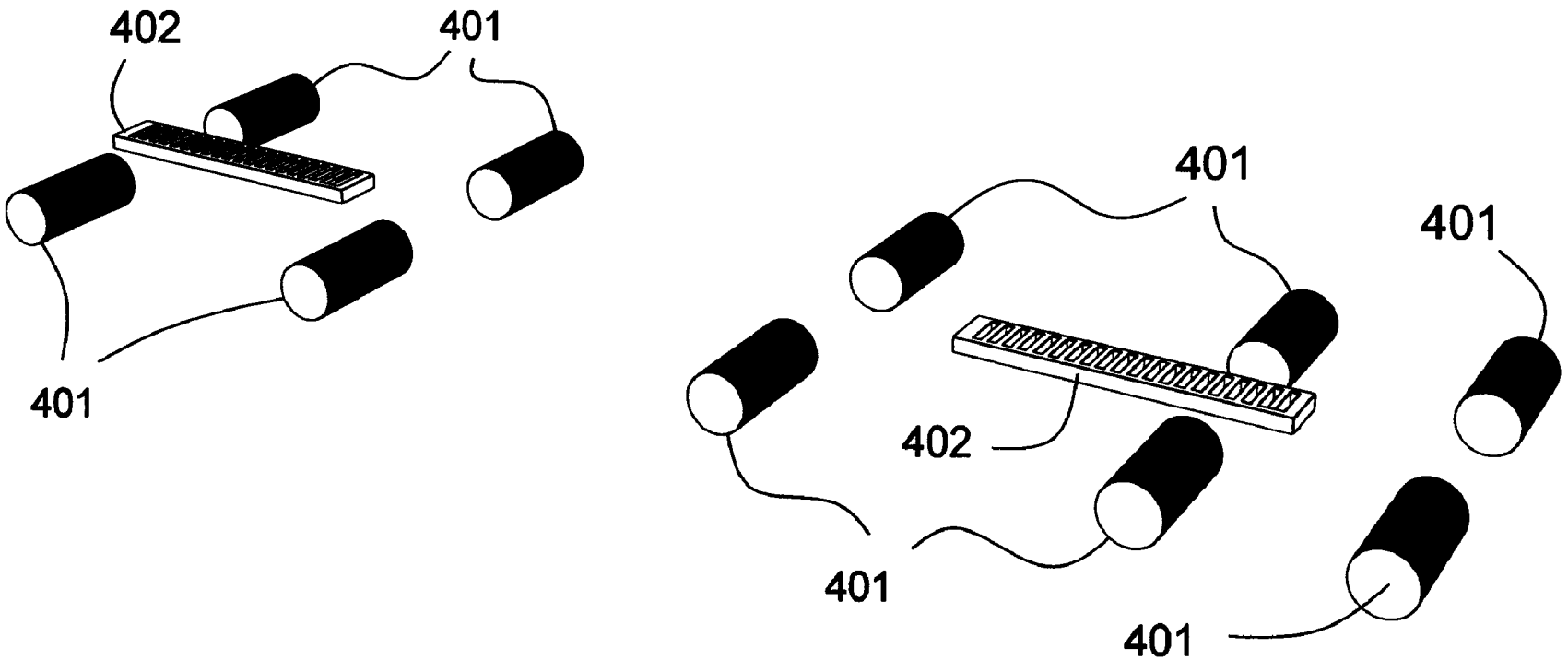
FIG. 3 (PRIOR ART)
FIG. 3 depicts a perspective view of a typical floor mounted roller/bracket assembly of a funeral hearse (floor/bed omitted for clarity)
Figure 5:
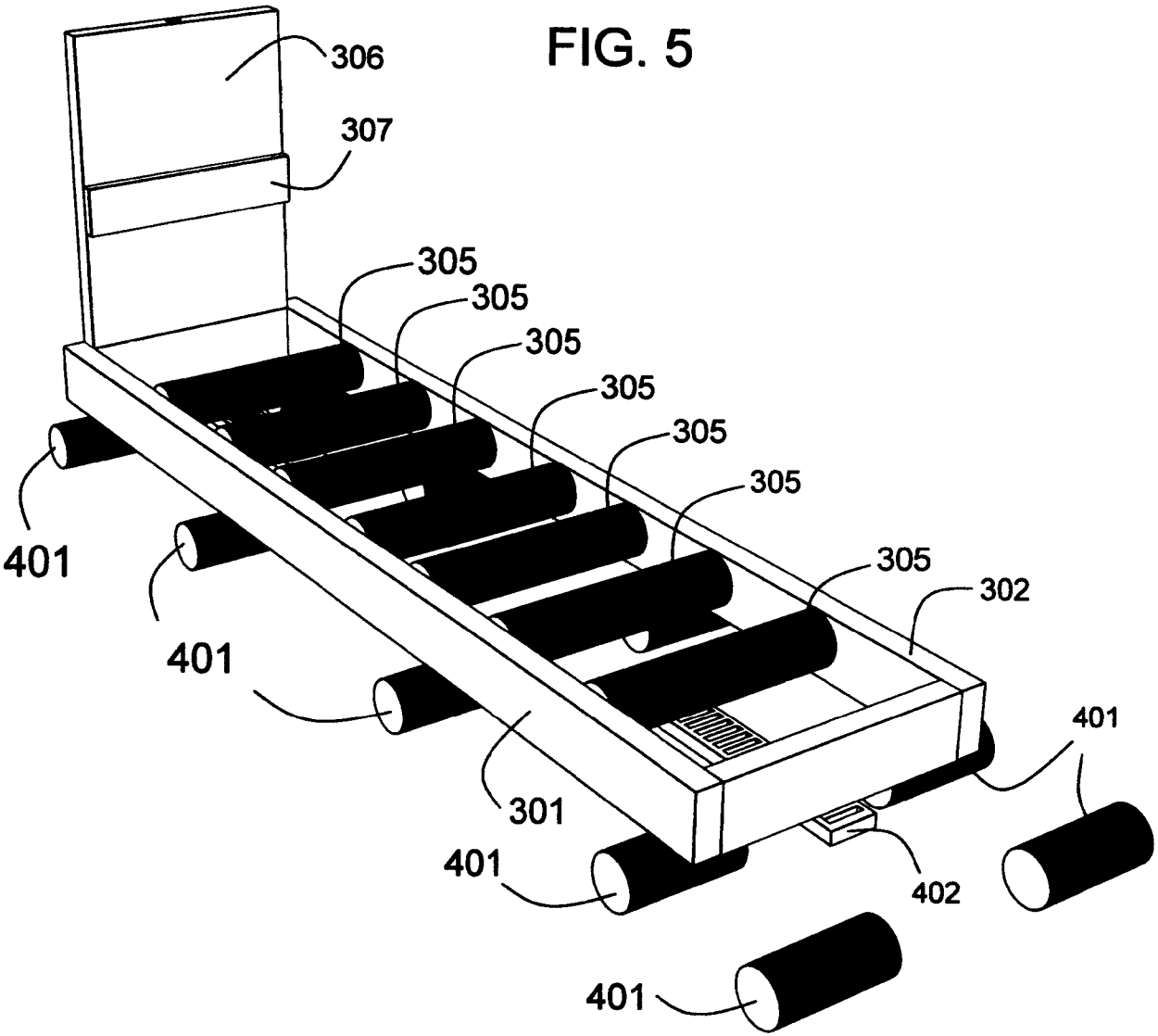
FIG. 5 depicts a perspective view of the carriage assembly relative to a typical floor mounted roller/bracket assembly of a funeral hearse

FIG. 3 depicts a typical roller and mounting bracket 401, 402 arrangement found in funeral coaches. The rollers and brackets are recessed into the bed (aka floor) of the coach to facilitate placement of a coffin by simply rolling it into the compartment. The present invention incorporates this existing system by rolling the carriage assembly into the compartment instead of a coffin and securing it in place. Then the coffin is rolled onto the carriage assembly (FIG. 5). For simplicity, the floor and exterior of the funeral coach are omitted.

One of skill in the art will appreciate that funeral coaches typically have two rows of rollers mounted in the floor (analogous to rollers 401) to facilitate placement of coffins and that these rows of rollers are spaced apart so as to correspond with typical coffin dimensions; accordingly, side rails 301 & 302 of carriage assembly 300 (spaced laterally apart to coincide with rollers 401) should be spaced to cooperate with typical funeral coaches.

What is claimed is:

1. A coffin carriage assembly comprising:

first and second side rails each having front and rear portions, and further being laterally spaced apart;

a front rail attached between the first and second side rails approximate the front portions thereof;

a back rail attached between the first and second side rails approximate the rear portions thereof;

a plurality of rollers attached with bearings to the first and second side rails between the front and back rails for receiving a coffin thereon, said rollers extending upwardly above the top of the first and second side rails;

a rear support wall being hingedly connected to the back rail and moveable between a first open position and a second closed position, and further extending vertically upward in the first open position, and being horizontally oriented in the second closed position;

a rear support pad connected to the rear support wall;

and a retaining strap having retracted and extended positions for removably securing the coffin, and further being connected at a first end to the top of the rear support wall, and further extendable to a second position and releasably connected at a second end to the top of the front rail.

2. The coffin carriage assembly of claim 1 wherein the coffin having a curved bottom surface, a recessed flat portion in the curved bottom surface, and two vertical side walls each having downwardly oriented lobes;

is placed on top of the carriage assembly such that the recessed flat portion of the coffin engages the plurality of rollers, and first and second side rails are disposed inside of the lobes.

3. The coffin carriage assembly of claim 1 wherein the carriage assembly is placed in a funeral coach having floor mounted rollers, such that the bottom of the first and second side rails engage the floor mounted rollers;

and further wherein the coffin having a curved bottom surface, a recessed flat portion in the curved bottom surface, and two vertical side walls each having downwardly oriented lobes, is placed on top of the carriage assembly such that the recessed flat portion of the coffin engages the plurality of rollers, and first and second side rails are disposed inside of the lobes.

* * * * *